United States Patent [19]

Vallius et al.

[11] 4,452,668

[45] Jun. 5, 1984

[54] METHOD AND APPARATUS FOR CHANGING A PICK-UP FABRIC AND/OR PRESS FABRIC IN A PAPER MACHINE

[75] Inventors: Oiva Vallius; Lassi Veijonen, both of Jyväskylä, Finland

[73] Assignee: Valmet Oy, Finland

[21] Appl. No.: 350,295

[22] Filed: Feb. 19, 1982

[30] Foreign Application Priority Data

Feb. 25, 1981 [FI] Finland ..... 810575

[51] Int. Cl.[3] ..... D21F 3/04; D21F 7/08; D21G 9/00

[52] U.S. Cl. ..... 162/199; 162/274; 162/360

[58] Field of Search ..... 162/199, 200, 205, 273, 162/274, 360

[56] References Cited

U.S. PATENT DOCUMENTS

| | | | |
|---|---|---|---|
| 2,290,087 | 7/1942 | Berry et al. | 162/200 |
| 2,297,593 | 9/1942 | Webb | 162/273 |
| 3,352,747 | 11/1967 | Lithgo et al. | 162/199 X |
| 3,900,364 | 8/1975 | Nelson et al. | 162/274 |
| 3,989,587 | 11/1976 | Grossman | 162/200 |
| 4,127,441 | 11/1978 | Stegelitz | 162/200 |

*Primary Examiner*—Richard V. Fisher
*Attorney, Agent, or Firm*—Steinberg & Raskin

[57] ABSTRACT

A method is employed in a press section of a paper machine for changing a pick-up and/or press fabric, the substantial run of which when the fabric is in its normal operating position, passes above a group of nip defining press rollers. Insert members of the machine frame are removed to define gaps therewithin and the press nip or nips through which the fabric passes are open. In the method, upper guide rollers situated within and guiding the loop of the fabric are shifted from an upper operating position occupied thereby when the fabric is in its normal operating position to a lower position and the fabric to be changed is transported with the same being wound in double manner on a changing pole. The fabric is opened and spread out to define a loop which encircles all of the press and guide rollers which will be situated within the fabric loop when the fabric is in its normal operating position. The loop so formed and transported is passed into the machine frame through the gaps defined therein by the removal of the insert members therefrom and into the open press nips. The fabric situated within the machine frame is spread out from the changing pole while the upper guide rollers are shifted from the lower position back to their upper operating position, whereupon the insert members are replaced in the machine frame and the opened press nips are closed.

10 Claims, 3 Drawing Figures

METHOD AND APPARATUS FOR CHANGING A PICK-UP FABRIC AND/OR PRESS FABRIC IN A PAPER MACHINE

BACKGROUND OF THE INVENTION

The present invention relates to a method employed in a press section of a paper machine, particularly in a closed press section, for changing a pick-up fabric and/or press fabric, the substantial run of which when the fabric is in its normal operating position, passes above a group of nip defining press rollers of the paper machine. In the method, insert members provided in one of the side frame components of the paper machine frame are removed and the press nip or nips through which the fabric passes is opened for the changing of the fabric.

The invention further relates to apparatus for performing the method and a press section with which the method can be employed, preferably a so-called closed press section.

The use of pick-up and press fabrics made of synthetic plastic material has recently become increasingly common in paper machine press sections. Such fabrics are being used to replace the textile fabrics which have been conventionally employed in the past. However, the introduction of such new fabrics has resulted in problems arising in connection with the changing thereof when such change becomes necessary.

Thus, in the changing of conventional textile felts according to known techniques, the new or changing textile felt has, for example, been compressed in the sideways or cross-machine direction, and then spread out starting at one margin thereof and carried into the machine frame through gaps or spaces defined by insert members removed from the paper machine frame. The textile felt encircles those rollers which will be situated within and lapped by the felt loop during actual operation.

As noted above, however, the changing of fabrics formed of synthetic material, such as plastic, is quite difficult, expecially in the case of so-called closed press sections such, for example, as in a "Sym-Press II" (a trademark of Valmet Oy of Helsinki, FInland) press section. In order to more clearly illustrate these problems, the structural arrangement of a "Sym-Press" press section will now be described.

A "Sym-Press II" press section comprises at least one pick-up fabric and two press fabrics, namely a first fabric operating as the pick-up fabric and which additionally serves as a press fabric in the first and second press nips of the press section, and a second fabric operating as a second press fabric in the first nip.

Thus, the "Sym-Press" press section comprises a suction roller over which the first fabric passes. Two press nips are defined in conjunction with the suction roller, the first press nip constituting a two-fabric press nip defined by the suction roller and a recessed-surface press roller. The second press nip constitutes a single-fabric nip, defined by the suction roller and a smooth-surface roller such as, for example, a stone roller. A third press nip is defined by another press roller, such as a recessed surface roller, and the stone roller. A third fabric loop passes through the third press nip.

SUMMARY OF THE INVENTION

The object of the present invention is to provide a method and apparatus for employment in a paper machine press section, such as a "Sym-Press" press or the like, by which the pick-up fabric and/or press fabric, or fabrics, of such press sections can be changed in a more rapid manner and using less complicated equipment then has been possible heretofore.

Another object of the present invention is to provide such method and apparatus whereby the fabric or fabrics of the press sections can be changed in a lateral direction while maintaining a relatively straight, that is, uncompressed, configuration.

It is a particular object of the present invention to provide method and apparatus by which the press section fabrics can be changed in an easy manner even when such fabrics are formed of synthetic material, such as plastic, which cannot be compressed into a small space or otherwise folded or crumpled in the sideways or transverse direction relative to the fabric loop.

Briefly, in accordance with the present invention, these and other objects are attained by providing a method wherein upper guide rollers to be situated within and guide the loop of the fabric are shifted from an upper operating position occupied thereby when the fabric is in its normal operating position to a lower position. The new or changing fabric is moved on a changing pole on which the fabric is wrapped in a double manner and the fabric is opened and spread out to define a loop which encircles all of the press and guide rollers, including the shifted upper guide rollers, which will be situated within the fabric loop when the fabric is in its normal operating position. The fabric loop transported in the aforedescribed manner is into the machine frame through the gaps defined in the side frame component by the removal of the insert members therefrom and into the open press nips. The fabric then situated within the machine frame is spread out from the changing pole while the upper guide rollers are shifted from the lower position to their upper operating position whereupon the fabric attains its normal operating position. The insert members are then replaced in the side frame components and the opened press nips closed.

According to the invention, apparatus is provided for performing the method set forth above including a changing pole which is supported for movement at its end regions by ropes or the like suspended from a crane.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figures 1, 2:
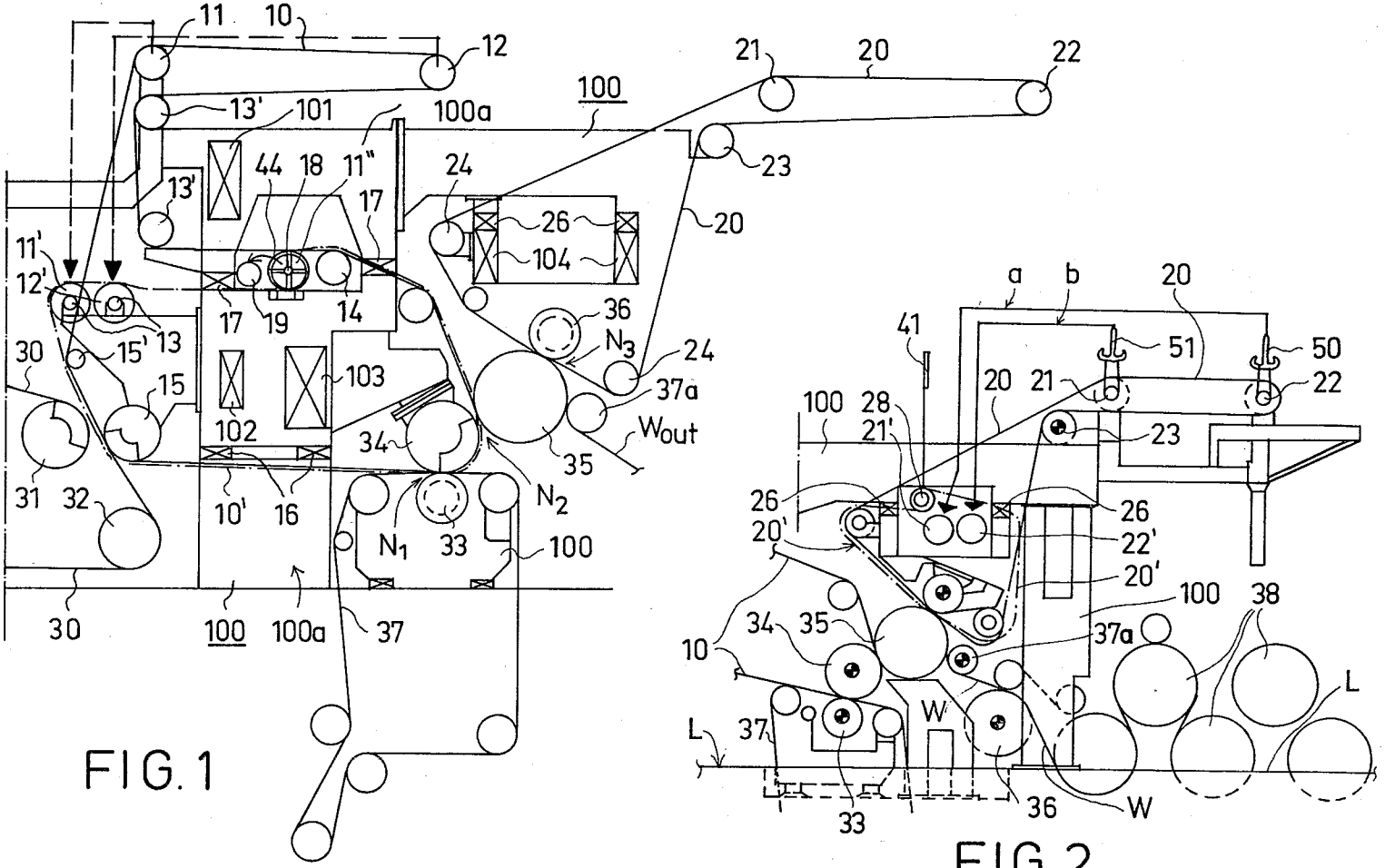
FIG. 1 is a schematic side elevation view of a paper machine press section, illustrating the pick-up fabric and press fabric changing method and apparatus of the present invention.
FIG. 2 is a view similar to FIG. 1, illustrating the changing of the press fabric which passes through the third press nip of the paper machine press section.

Referring now to the drawings, wherein like reference characters designate identical or corresponding parts throughout the several views, a so-called closed press section of the "Sym-Press" type is illustrated. The press section includes a pick-up roller 15 by which the web is detached from a forming wire 30 on the run between the suction roller 31 and the wire traction roller 32. The press structure itself is constituted by a group of rollers including a recessed-surface roller 33, which together with a suction roller 34 defines a first press nip $N_1$. The first press nip $N_1$ is a double-felted nip. Thus, a first fabric 10 which functions both as a pick-up fabric as well as a press fabric, and a second or lower fabric 37 within the loop of which the recessed-surface roller 33 is situated, pass through the first press nip $N_1$. Moreover, the press section includes a smooth-surfaced central roller 35 which defines a second press nip $N_2$ with the suction roller 34. A third press nip $N_3$ of the press section is defined between the central roller 35 and a recessed-surface press roller 36. The third press nip $N_3$ has its own press fabric 20.

The transport of the web W after the press section is known in the art. Thus, the web is detached from the smooth-surface roller 35 by a roller 37*a* as designated by Wout and further conducted to a drying section, the lead-in cylinder 36 and some of the drying cylinders 38 of which are illustrated in FIG. 2.

The present invention provides a new method and apparatus for changing the pick-up and press fabric 10 and/or the press fabric 20 of the press section. In this connection, the frame structure of the paper machine as well as the position of various rollers thereof have been altered to facilitate carrying out of the method of the invention.

More particularly, the frame structure of the paper machine, generally designated 100, comprises side frame components 100*a* and 100*b* (FIG. 3) between which cantilevered beams 101, 102, 103 and 104 extend. The cantilevered beams are carried at one end by fixing elements 121 provided on the wall of the building or any other similar vertical frame member.

For the purpose of changing the pick-up and press fabric 10, one of the side frame components, specifically the side frame component 100*a*, normally contains insert members 16 and 17, known per se in the art, which can be removed from the side frame component 100*a* to define a space or gap used in the changing of the fabric 10. Similarly, insert members 26 are provided in the frame component 100 in association with the transverse beams 104 to permit changing of the press fabric 20.

As shown in FIG. 1, an upper roller 14 constitutes an automatic guide roller of the fabric 10 and a roller 15' constitutes a curved spreading roller fabric 10. It is noted that the rollers 14 and 15' occupy respective locations which are substantially lower in height than their corresponding positions in conventional press sections wherein they were mounted at locations considerably above those illustrated in FIG. 1. When the rollers 14 and 15' are disposed at such lower positions in accordance with the present invention and as shown in FIG. 1, they can then be included in a first slip-in group of the fabric 10. Moreover, it is then only necessary to shift the upper guide rollers 11 and 12 into respective lower positions 11' and 12' wherein they form a part of the first slip-in group, for carrying out the method of the invention.

Figure 3:
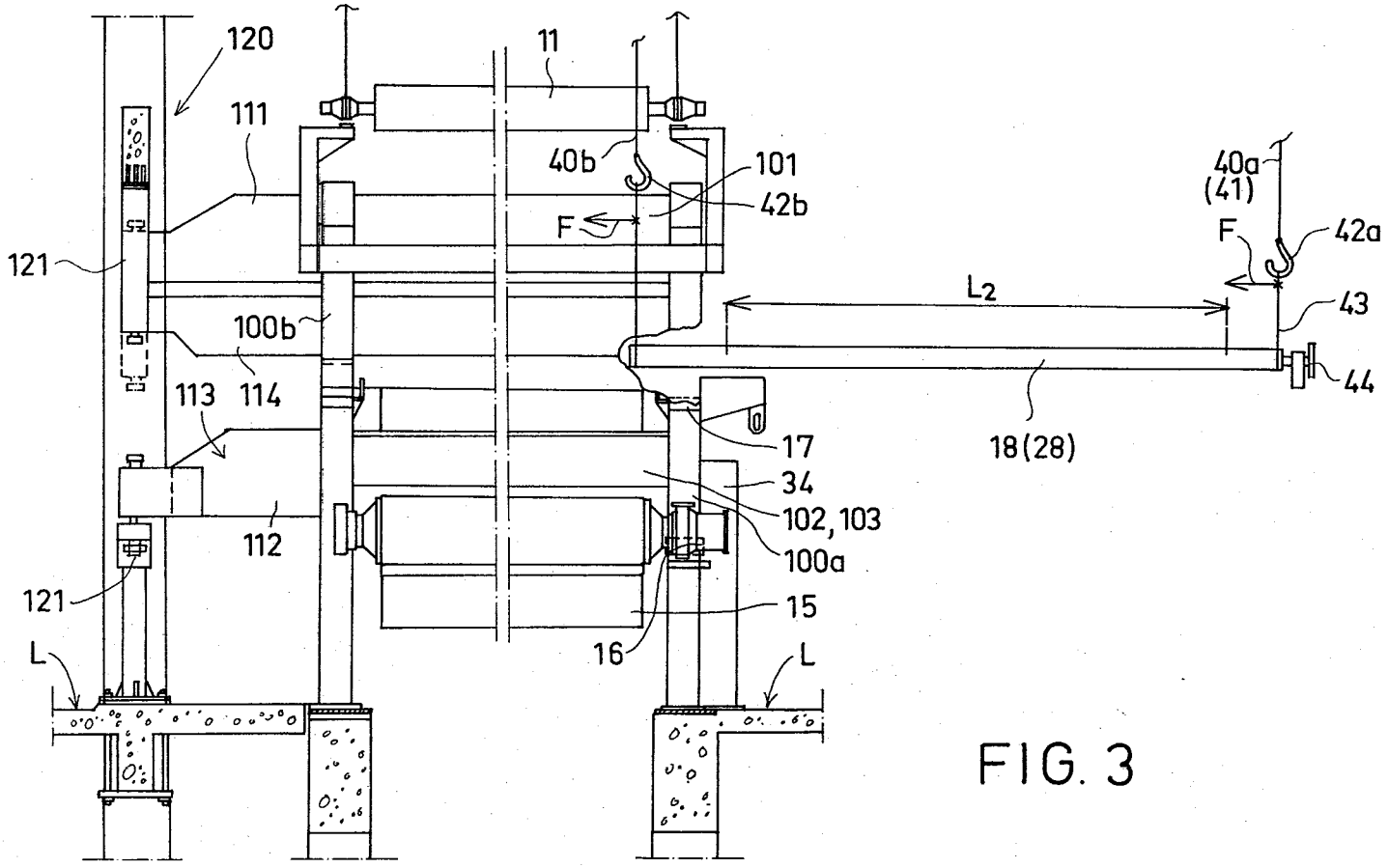
FIG. 3 is a schematic elevation view in the machine direction showing the carrying out of the method of the present invention.

Referring now to FIGS. 1 and 3, the method of the present invention will be described in connection with the changing of the fabric 10 and further describing the apparatus of the invention.

Prior to beginning the actual installation of the new or changing fabric, the upper felt guide rollers 11 and 12 are moved from their upper operating position which they occupy when the fabric 10 is in its normal operating position, as shown by the solid lines, to respective lower positions 11' and 12'. Special support components 13 provided on the machine frame serve to mount the felt guide rollers at their lower positions 11' and 12'. This shifting of the upper guide rollers is preferably performed utilizing an overhead crane of the type typically found in a paper machine hall.

The fabric 10 is formed, for example, of a plastic fabric material which cannot be compressed or crumpled or folded efficiently in the transverse or cross-machine direction. Upon removal of the old fabric, the new or changing fabric 10 is transported to the changing area wound in a double manner, i.e., wrapped double, around a changing pole 18. The changing pole 18 is supported for movement at its end regions by means of hooks 42*a* and 42*b* affixed to the ends of crane ropes 40*a* and 40*b* through the mediation of a wire rope 43. The reference character $L_2$ indicates the area on the changing pole 18 where the new or changing fabric 11 has been wrapped.

The changing pole 18 supported in the manner illustrated in FIG. 3 is moved or transported in the cross-machine direction to a position within the machine frame.

During the movement of the changing pole 18 as hereinbefore described, and starting from the position of the changing pole illustrated in FIG. 3, an appropriate amount of the fabric 10 wrapped around the pole is unwound, that is, opened and spread out, and passed into the machine frame through the gaps provided in the side frame component 100*a* by the removal of the insert members 16 and 17 therefrom, to encircle the rollers 11', 12', 14, 15, 15' and 34, which rollers comprise a first slip-on group of rollers. The fabric is also passed into the press nips $N_1$ and $N_2$ which have previously been opened. As noted above, the fabric 10' shown by the dotted lines is transported through the gaps provided in the side frame component into the machine frame while the changing pole 18 is being moved in the cross-machine direction, designated by arrows F in FIG. 3.

When the fabric 10 is situated within the machine frame, that is, between the side frame components 100*a* and 100*b*, with the fabric having the configuration designated 10', a hand wheel 44 provided at one end of the changing pole 18 is rotated to rotate said pole and thereby commence the unwinding or spreading out of the fabric from said changing pole. Simultaneously, one or both guide rollers 11' and 12', are shifted from their lower positions to their upper operating positions 11 and 12, in which connection the guide rollers 13' guide the fabric 10 as it unwinds from the pole 18. When the upper guide rollers 11 and 12 are located in their upper operating positions, the fabric 10 is pulled taut to attain its normal operating position illustrated in FIG. 1. The insert members 16 and 17 are replaced in the side frame component 100*a* whereupon the changing of the fabric 10 is complete. The changing pole 18 is withdrawn from the machine frame at a location 19 in FIG. 1 and transported to its storage area, or the like.

Changing of the press fabric 20 is accomplished in substantially the same manner as hereinbefore described above in connectio n with the changing of the fabric 10. Referring to FIG. 2, the upper guide rollers 21 and 22 are moved, prior to the changing of fabric 20, to lower positions 21' and 22' where they are supported by suitable supporting elements (not shown) of the machine frame. The arrows designated a and b illustrate this shifting of the upper guide rollers 21 and 22 which is preferably accomplished utilizing hooks 50 and 51 attached to crane ropes, or the like.

With the insert members 26 removed from the frame component, the changing fabric 20, supported by the pole 28 in a manner similar to that described, is transported in the cross-machine direction. At the same time, the fabric 20 is opened and spread out to define the configuration of a loop designated 20' which encircles all of the press and guide rollers, including the shifted upper guide rollers 21' and 22', which are situated within the fabric loop when the fabric 20 is in its normal operating position. The fabric 20 is simultaneously passed into the press nip $N_3$, which has previously been opened.

With the fabric having the configuration of the loop 20' situated within the machine frame due to the use of the changing pole 28, said pole is rotated as hereinbefore described to spread the fabric 20' out. Simultaneously, the guide rollers are moved from the lower position, designated 21' and 22' into their upper operating positions 21 and 22 with the aid of the hooks 51 and 50, whereupon the changing method continues as hereinbefore described in connection with the changing of fabric 10. A guide roller 23 guides the fabric as it spreads out, that is, as the fabric 20 is unwound from the pole 18.

The method and apparatus described are thus specifically directed to the changing of fabrics, such as, for example, fabrics 10 and 20, which are located above the floor level of the paper machine.

Obviously, numerous modifications and variations of the present invention are possible in the light of the above teachings. It is therefor to be understood that within the scope of the claims appended hereto, the invention may be practiced otherwise than as specifically disclosed herein.

What is claimed is:

1. A method employed in a closed press section of a paper making machine for changing a looped pick-up or press fabric, the substantial run of which when the fabric is in its normal operating position passes above a group of nip defining press rollers of said paper making machine, said machine including a machine frame having a side frame component from which insert members are removed to provide gaps therewithin and wherein the press nip or nips through which the fabric passes are opened for the changing of the fabric, said method comprising the steps of shifting upper guide rollers situated within and guiding the loop of the fabric from an upper operating position occupied thereby when the fabric is in its normal operating position to a lower position essentially lower than the normal operating positions of said upper guide rollers;

transporting the changing fabric on a changing pole on which the fabric is wound in a double manner, and opening and spreading out said fabric to define a loop which encircles all said press and guide rollers, including the shifted upper guide rollers, which are situated within the fabric loop when the fabric is in its normal operating position;

passing the preliminary fabric loop being so transported into the machine frame through the gaps provided in the side frame component by the removal of the insert members therefrom and into the operating press nips; and spreading the fabric out from said changing pole while shifting the upper guide rollers from their lower positions to their upper operating positions when the fabric is located within the machine frame whereupon said fabric attains its normal operating position and the insert members are replaced in the side frame component and the opened press nips are closed.

2. A method as claimed in claim 1, wherein said changing pole is supported for movement at its end regions by ropes, or the like, of an overhead crane, the transporting of the changing fabric and said changing pole on which said fabric is wound, with said fabric being opened and spread out to define a loop, and passing of the loop so formed through the gaps provided in the side frame component by the removal of the insert members therefrom and into the open press nips are conducted by moving said changing pole supported by said ropes, or the like, with said changing fabric wound thereon in a cross-machine direction to a position within the machine frame, and the changing pole is withdrawn from the machine frame after the spreading of said fabric situated within said machine frame out from said changing pole while shifting said upper guide rollers to their upper operating positions whereupon said fabric attains its normal operating position.

3. A method as claimed in claim 2, wherein said changing pole, during the step of moving said changing pole with said changing fabric wound thereon to a position within said machine frame is located in substantially the same horizontal plane as the upper ones of said removable insert members.

4. A method as claimed in claim 1, wherein the spreading of said fabric situated within said machine frame out from said changing pole which is also situated within said machine frame is accomplished by rotating said changing pole while shifting said upper guide rollers to their upper operating positions.

5. A method as claimed in claim 1, further comprising supporting said upper guide rollers of the fabric loop after shifting to the lower positions by supporting members constituting frame components, said supporting members being situated substantially in the same horizontal plane as the upper ones of the removable insert members.

6. Apparatus in a closed press section of a paper making machine for changing a looped pick-up or press fabric, the substantial run of which when the fabric is in its normal operating position passes above a group of nip defining press rollers of said paper making machine, said machine including a machine frame having a side frame component from which insert members are removed to provide gaps therewithin and wherein the press nip or nips through which the fabric passes are opened for the changing of the fabric, said apparatus comprising upper guide rollers situated within and guiding the loop of the fabric;

shifting means for shifting said guide rollers from upper operating positions occupied thereby when said fabric is in its normal operating position to a lower position essentially lower than the normal operating positions of said upper guide rollers;

a changing pole having said fabric wound thereon in a double manner;

transporting means for transporting said changing fabric on said changing pole and opening and spreading out said fabric to define a loop which encircles all said press and guide rollers, including said shifted upper guide rollers, which are situated within the fabric loop when said fabric is in its normal operating position;

means for passing the preliminary fabric loop being so transported into said machine frame through the gaps provided in the side frame component by the removal of the insert members therefrom and into the operating press nips; and spreading means for spreading said fabric out from said changing pole while shifting said upper guide rollers from their lower positions to their upper operating positions when said fabric is located within said machine frame whereupon said fabric attains it normal operating position and said insert members are replaced in the side frame component and the opened press nips are closed.

7. Apparatus as claimed in claim 6, further comprising supporting means for said changing pole, said supporting means supporting said changing pole for movement at its end regions and including ropes, or the like, of an overhead crane, and wherein said transporting means transports said changing fabric and said changing pole on which said fabric is wound, with the fabric being opened and spread out to define a loop, and passes said loop so formed through the gaps provided in the side frame component by the removal of the insert members therefrom and into the open press nips by moving said changing pole supported by said ropes, or the like, with said changing fabric wound thereon in a cross-machine direction to a position within said machine frame and withdraws said changing pole from said machine frame after the spreading of said fabric situated within said machine frame out from said changing pole while shifting said upper guide rollers to their upper operating positions whereupon said fabric attains its normal operating position.

8. Apparatus as claimed in claim 6, further comprising rotating means on said changing pole for spreading said fabric situated within said machine frame out from said changing pole which is also situated within said machine frame by rotating said changing pole while shifting said upper guide rollers to their operating positions.

9. Apparatus as claimed in claim 6, further comprising additional supporting means for supporting said upper guide rollers of said fabric loop after shifting to the lower positions, said additional supporting means comprising supporting members constituting frame components, said supporting members being located substantially in the same horizontal plane as the upper ones of said removable insert members.

10. Apparatus as claimed in claim 6, wherein said changing pole is in substantially the same horizontal plane as the upper ones of said removable insert members during the moving of said changing pole with said changing fabric wound thereon to a position within said machine frame.

* * * * *